US006208052B1

(12) United States Patent
Kershaw et al.

(10) Patent No.: US 6,208,052 B1
(45) Date of Patent: Mar. 27, 2001

(54) COOLING MODULE FOR AN ELECTRONICALLY CONTROLLED ENGINE

(75) Inventors: Peter A. Kershaw; Marek Horski, both of London (CA)

(73) Assignee: Siemens Canada Limited, London (CA)

( * ) Notice: Subject to any disclaimer, the term of this patent is extended or adjusted under 35 U.S.C. 154(b) by 0 days.

(21) Appl. No.: 09/376,848

(22) Filed: Aug. 18, 1999

(51) Int. Cl.[7] ..... H02K 5/18; H02K 5/16; H02K 5/00; H02K 7/14

(52) U.S. Cl. ..... 310/91; 310/64; 310/62; 310/67 R; 165/121

(58) Field of Search ..... 310/62, 63, 67 R, 310/89, 91, 64, 68 R; 165/120, 121; 417/423.12

(56) References Cited

U.S. PATENT DOCUMENTS

| | | | | |
|---|---|---|---|---|
| 4,406,581 | | 9/1983 | Robb et al. | 415/172 |
| 4,407,087 | | 10/1983 | Barge | 417/356 |
| 4,407,641 | | 10/1983 | Barge | 417/356 |
| 4,431,931 | * | 2/1984 | Perrier et al. | 310/61 |
| 4,459,087 | | 7/1984 | Barge | 417/356 |
| 4,548,548 | | 10/1985 | Gray, III | 416/189 |
| 4,685,513 | | 8/1987 | Longhouse et al. | 165/121 |
| 4,836,148 | | 6/1989 | Savage et al. | 123/41.49 |
| 4,883,982 | * | 11/1989 | Forbes et al. | 310/62 |
| 4,949,022 | | 8/1990 | Lipman | 318/254 |
| 4,953,811 | | 9/1990 | Smith | 244/17.19 |
| 4,962,734 | | 10/1990 | Jorgensen | 123/41.49 |
| 5,522,457 | | 6/1996 | Lenz | 165/121 |
| 5,597,038 | | 1/1997 | Potier | 165/121 |
| 5,758,716 | | 6/1998 | Shibata | 165/41 |
| 5,771,961 | | 6/1998 | Alizadeh | 165/121 |
| 5,783,881 | * | 7/1998 | Best et al. | 310/68 C |
| 5,973,428 | * | 10/1999 | Zakrocki et al. | 310/71 |
| 6,050,786 | * | 4/2000 | Lin | 417/366 |

* cited by examiner

*Primary Examiner*—Clayton LaBalle

(57) ABSTRACT

A cooling module 10 of short axial length includes a fan 18 having a plurality of blades 16. A shroud structure 12 is spaced from and generally adjacent to the blades 16. A brushless electric motor 22 rotates the blades 16. The motor 22 includes a heat sink structure 24 coupled to the shroud structure 12 and defines a base of the motor 22. A shaft 32 is fixed to the heat sink structure 24. A rotor 34 is mounted for rotation with respect to the shaft 32. The fan 18 is coupled to the rotor 34. Magnets 48 are fixed in relation to the rotor 34. A lamination core 56 is fixed to the heat sink structure 24. A winding is wound about the lamination core 56 and is operatively associated with the magnets 48.

21 Claims, 4 Drawing Sheets

COOLING MODULE FOR AN ELECTRONICALLY CONTROLLED ENGINE

FIELD OF THE INVENTION

This invention relates to cooling modules for electronically controlled engines and, more particularly, to cooling modules having fewer parts and short overall axial lengths.

BACKGROUND OF THE INVENTION

Typical cooling modules for vehicle engines generally include three separate parts: a fan, an electric motor to drive the fan, and a shroud to cover the blades of the fan and to mount the module. An example of such a module is shown in U.S. Pat. No. 4,548,548 to Gray, III. The structure disclosed in the Gray, III patent includes a motor that is not easily integrated with the fan and shroud, which results in a module having a significant overall axial length.

In certain applications, due to space and environmental constraints, it is desirable to provide an engine cooling module of reduced axial length and, to reduce costs, having reduced number of module parts.

Accordingly, there is a need to provide an improved cooling module for an electronically controlled engine which has a motor integrated with a fan and shroud to provide a module having a reduced axial length and fewer parts.

SUMMARY OF THE INVENTION

An object of the present invention is to fulfill the need referred to above. In accordance with the principles of the present invention, this objective is obtained by providing a cooling module including a fan having a plurality of blades. A shroud structure is spaced from and generally adjacent to the blades. A brushless electric motor rotates the fan. The motor includes a heat sink structure coupled to the shroud structure and defines a base of the motor. A shaft is fixed to the heat sink structure. A rotor is mounted for rotation with respect to the shaft. The fan is coupled to the rotor. Magnets are fixed in relation to the rotor so as to rotate with the rotor. A lamination core is fixed to the heat sink structure. A winding is wound about the lamination core and is operatively associated with the magnets. The structure and arrangement of the cooling module provides a reduced overall axial length of the module and fewer module parts than conventional cooling modules.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

FIG. 2 FIG. 1 sectional view of the motor of the cooling module of FIG. 1 taken along line B—B of FIG. 3;

DETAILED DESCRIPTION OF THE INVENTION

Figure 1:
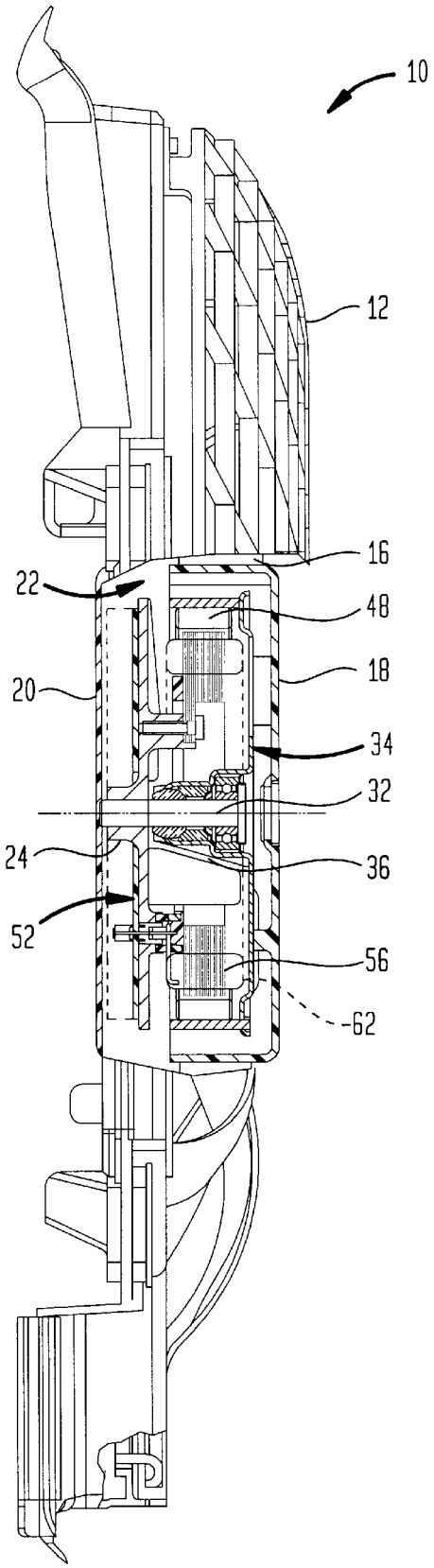
FIG. 1 is a side view, partially in section, of a cooling module of an electronically controlled engine, provided in accordance with the principles of the present invention.
Figure 3:
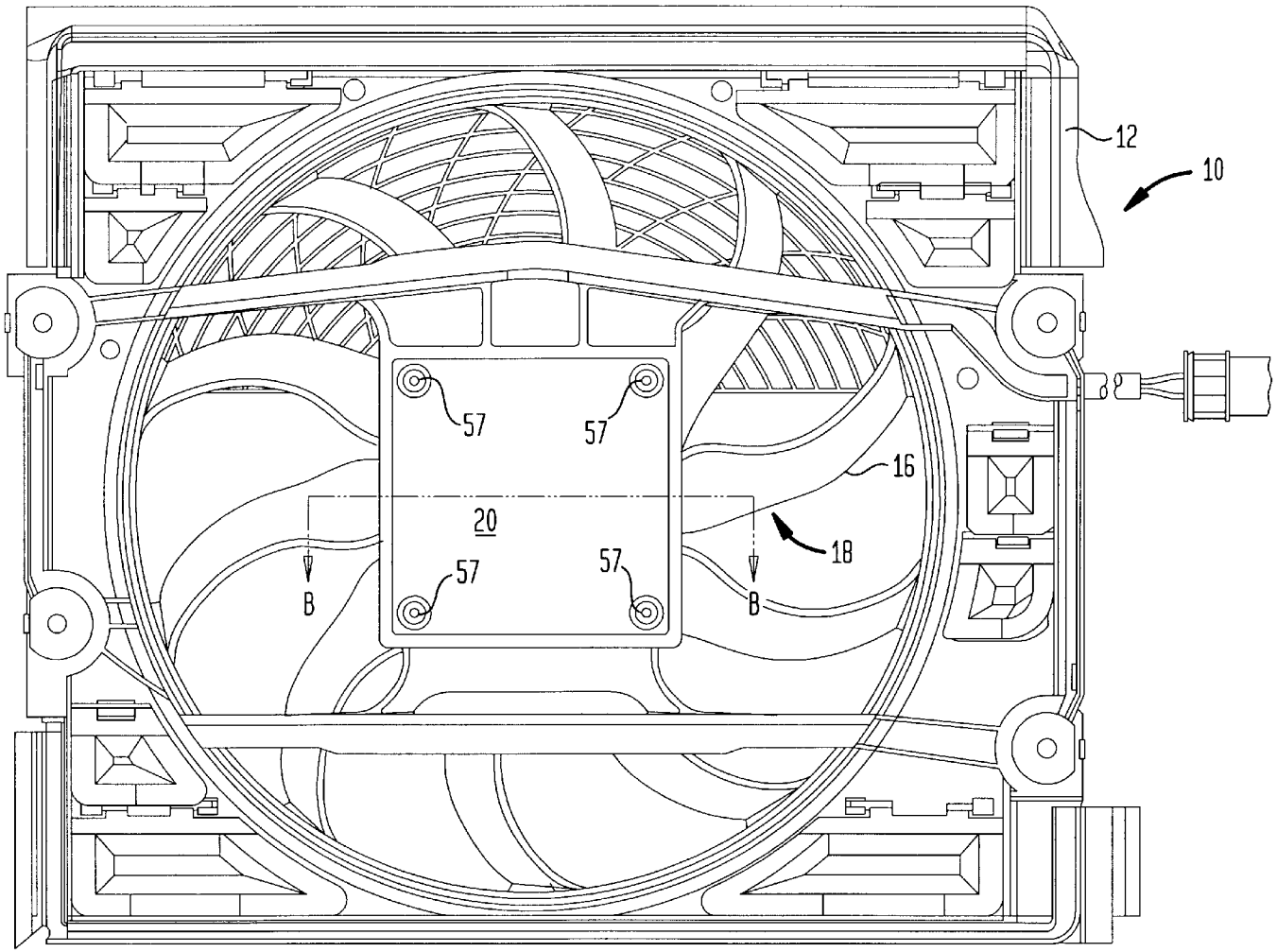
FIG. 3 is a rear view of the cooling module of the invention.

Referring to FIG. 1, a cooling module for an electronically controlled engine is shown, generally indicated 10, provided in accordance with the principles of the present invention. The cooling module 10 includes a shroud structure 12, formed preferably of lightweight material such as plastic. In the conventional manner and as best shown in FIG. 3, the shroud structure 12 is spaced from and generally adjacent to blades 16 of a fan 18 of the module 10 to prevent foreign objects from contacting the rotating blades. The shroud structure 12 also has a mounting base 20.

Figure 2:
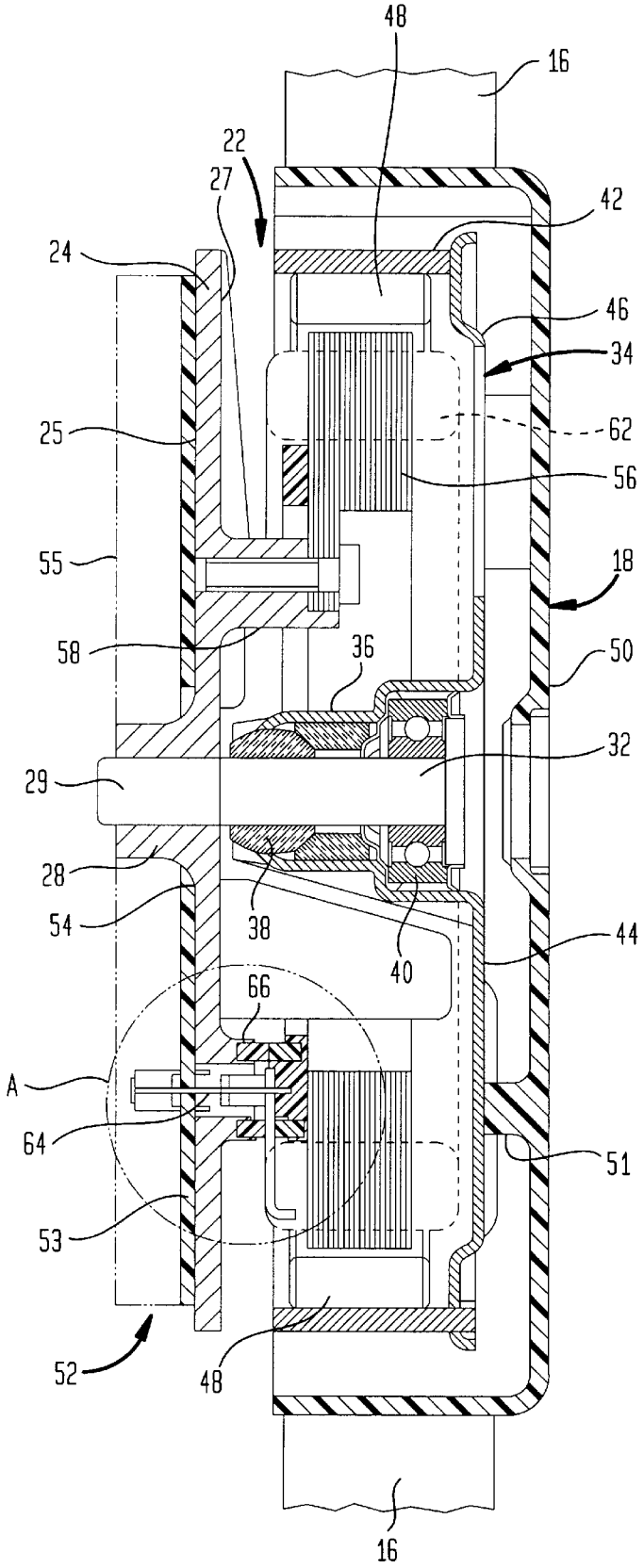

With reference to FIG. 2, the module 10 includes a brushless dc electric motor, generally indicated at 22, coupled to the mounting base 20 of the shroud structure 12. In particular, the motor 22 has a heat sink structure 24 defining a base of the motor 22. Due to the heat sink structure 24, advantageously, an end cap is not required at this end of the motor 22. The heat sink structure 24 is of generally plate-shape having a first surface 25 and an opposing second surface 27. A central boss 28 extends outwardly from the first surface 25 and is disposed adjacent to the mounting base 20 of the shroud structure 12. The heat sink structure 24 is preferably made of metal or other material suitable for a heat sink. An end of a stationary shaft 32 of the motor 22 is fixed to the central boss 28 via engagement with aperture 29.

The motor 22 includes a rotor, generally indicated at 34, having a hub 36 which is mounted for rotation about the shaft 32. The rotor is preferably an aluminum casting. The hub 36 is supported for rotation by a front bearing 38 and a rear bearing 40. A flux ring 42 is coupled to a peripheral portion of the rotor 34 via rotor portions 44 and 46 which extend from the hub 36. Rotor portions 44 and 46 each have an opening (not shown) for receiving tabs (not shown) of the flux ring 42 for coupling the flux ring 42 to the rotor 34 in a conventional manner. Permanent magnets 48 are carried by the flux ring 42. A hub 50 of the fan 18 is secured to the rotor portions 44 and 46 via screws or pins or clips at boss 51 so as to substantially surround the entire periphery of the rotor 34. Fan hub 50 carries the blades 16.

As best shown in FIG. 2, an electronic control unit, generally indicated at 52, is mounted to the heat sink structure 24 at a first surface 54 of the heat sink structure 24 so as to be disposed between the mounting base 20 (FIG. 3) of the shroud structure 12 and the heat sink structure 24. The electronic control unit 52 includes a printed circuit board (PCB) 53 having components (not shown) thereon. The maximum distance the components extend from the circuit board 53 is indicated by dashed line 55 in FIG. 2. As best shown in FIG. 3, the control unit 52 and heat sink structure 24 are mounted to the mounting base 20 of the shroud structure via four screws 57. The screws 57 extend from the mounting base 20 through the circuit board 53 and into the heat sink structure 24.

Figure 2A:
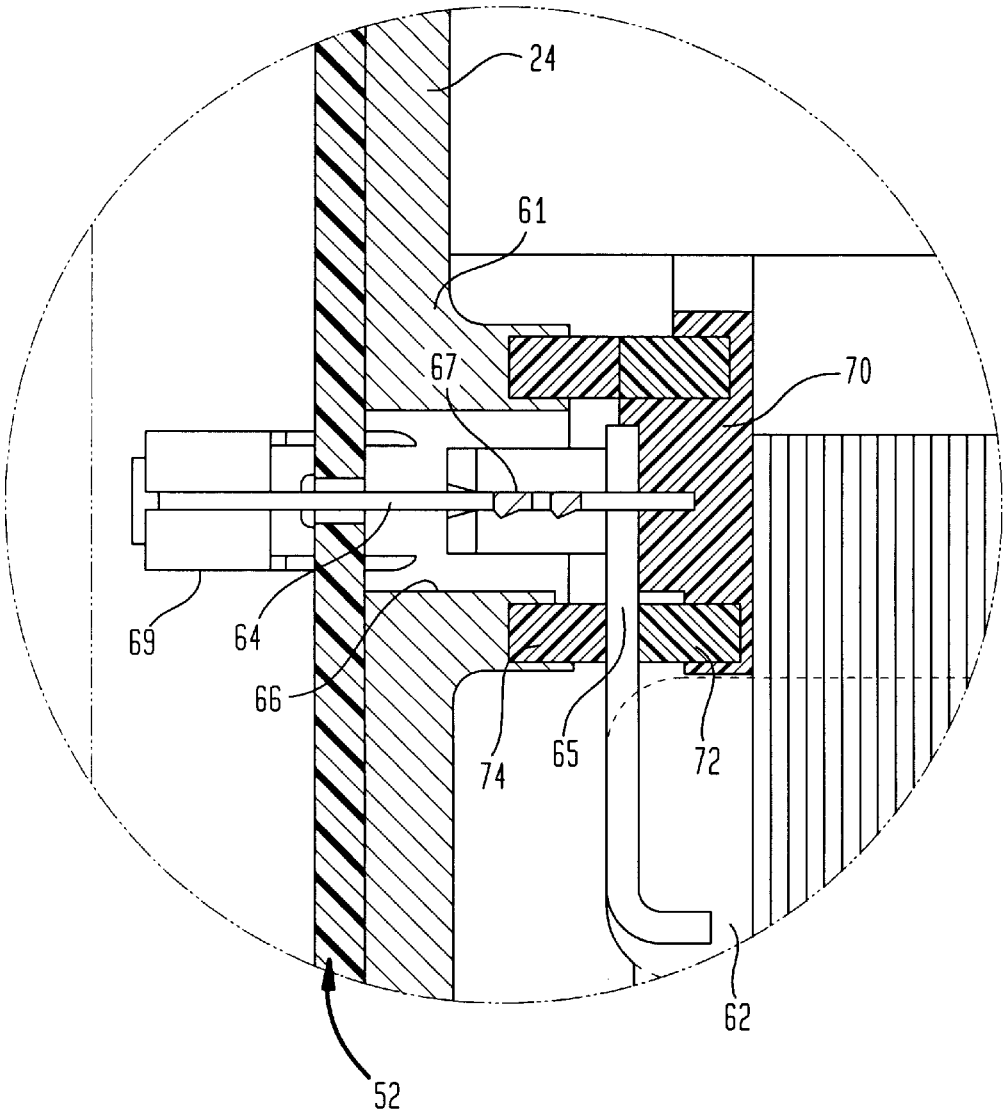
FIG. 2*a* is an enlarged view of the encircled portion A of FIG. 2.

In addition, a lamination core 56 of the motor 22 is fixed, via bolting or the like, to at least one boss 58 extending from the second surface 27 of the heat sink structure 24. In the typical manner, a winding 62 is wound about the lamination core 56 such that as the rotor 34 rotates, the permanent magnets 48 come into close proximity with the winding 62. Wiring 64 for the winding 62 is connected to the electronic control unit 52 and extends through aperture 66 in boss 61 in the heat sink structure 24 to provide direct current to the winding 62. As best shown in FIG. 2*a*, end 65 of a winding 62 is joined to an end 67 of a winding-PCB connector 69 to electrically connect the winding 62 to the electronic control unit 52. A terminal ring 70 is disposed opposite boss 61 and supports the end of 65 of the winding 62 and end 67 of the connector 69. An terminal ring seal 72 is associated with the terminal ring 70 and an PCB seal 74 is associated with the boss 61 of the heat sink structure 24. The seals 72 and 74 are preferably made of rubber or other elastomer material. As shown in FIG. 2*a*, the end 65 of the winding 62 is sandwiched between the seals 72 and 74 to ensure a substantially sealed connection between the winding 62 and the electronic control unit 52.

The motor 22 operates in the conventional manner upon energizing the winding 62 causing the rotor 34 and thus the fan blades 16 to rotate.

In the conventional manner, the cooling module 10 of the invention can be mounted as a unit to be operatively associated with a radiator of a vehicle for cooling the engine of the vehicle.

The cooling module 10 is of reduced axial length as compared to conventional cooling modules. Advantageously, the reduced axial length cooling module of the invention does not consume as much valuable engine compartment space as does conventional cooling modules.

Furthermore, since the heat sink structure 24 eliminates a motor end cap, the module 10 has fewer parts. Also, since the fan hub 50 generally surrounds the periphery of the rotor 34, a painting process of the rotor can be eliminated.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A cooling module comprising:

a fan having a plurality of blades;

a shroud structure spaced from and generally adjacent to said blades; and a brushless electric motor for rotating said fan, said electric motor comprising:

a heat sink structure coupled to said shroud structure and defining a base of said motor;

a shaft fixed to said heat sink structure;

a rotor mounted for rotation with respect to said shaft, said fan being coupled to said rotor;

magnets fixed in relation to said rotor so as to rotate with said rotor;

a lamination core fixed to said heat sink structure; and a winding wound about said lamination core and operatively associated with said magnets.

2. The cooling module according to claim 1, further comprising an electronic control unit mounted between said shroud structure and said heat sink structure so as to power said winding.

3. The cooling module according to claim 2, wherein said heat sink structure includes an aperture therein, wiring for said winding is coupled to said electronic control unit, extends through said aperture and is coupled to said winding.

4. The cooling module according to claim 3, wherein a substantially sealed connection is provided between said winding and said electronic control unit.

5. The cooling module according to claim 3, wherein said heat sink structure includes a boss having said aperture therein, a connector extending through said aperture and having a first end electrically connected to said electronic control unit and second end electrically connected to said winding, said substantially sealed connection including a terminal ring disposed opposite said boss and supporting said second end of said of said connector, a first seal ring associated with said terminal ring and a second seal ring associated with said boss of said heat sink structure with an end of said winding being sandwiched between at least of portion of said first and second seal rings.

6. The cooling module according to claim 1, wherein said heat sink structure has opposing first and second surfaces, a first boss extends from said first surface having said shaft fixed thereto, said first boss being adjacent to said shroud structure, said second surface having at least one second boss extending therefrom, said lamination core being fixed to said at (east one second boss.

7. The cooling structure according to claim 1, wherein a flux ring is coupled to said rotor at a peripheral portion thereof, said flux ring carrying said magnets.

8. The cooling structure according to claim 1, wherein said heat sink structure is composed of metal.

9. The cooling structure according to claim 7, wherein said fan has a fan hub coupled to the rotor, said blades being coupled to said fan hub.

10. The cooling module according to claim 9, wherein said fan hub substantially surrounds a periphery of said rotor and said flux ring.

11. The cooling module according to claim 1, wherein said rotor has a hub supported for rotation about said shaft by bearings.

12. A cooling module comprising:

a fan having a fan hub and a plurality of blades extending from said fan hub;

a shroud structure spaced from and generally adjacent to said blades; and a brushless electric motor for rotating said fan, said electric motor comprising:

a heat sink structure having first and second opposing surfaces, said first surface including a boss extending therefrom, said boss having an aperture therein, said boss being adjacent to said shroud structure, said heat sink structure defining a base of said motor;

a shaft fixed with respect to said aperture of said boss of said heat sink structure;

a rotor mounted for rotation with respect to said shaft, said fan hub being coupled to said rotor;

magnets fixed in relation to said rotor so as to rotate with said rotor;

a lamination core fixed to at least one boss extending from said second surface of said heat sink structure; and a winding wound about said lamination core and operatively associated with said magnets.

13. The cooling module according to claim 12, further comprising an electronic control unit mounted between said shroud structure and said first surface of said heat sink structure so as to power said winding.

14. The cooling module according to claim 13, wherein said heat sink structure includes an aperture therein, wiring for said winding is coupled to said electronic control unit, extends through said aperture and is coupled to said winding.

15. The cooling structure according to claim 12, wherein a flux ring is coupled to said rotor at a peripheral portion thereof, said flux ring carrying said magnets.

16. The cooling structure according to claim 12, wherein said heat sink structure is composed of metal.

17. The cooling structure according to claim 15, wherein said fan has a fan hub coupled to the rotor, said blades being coupled to said fan hub.

18. The cooling module according to claim 17, wherein said fan hub substantially surrounds a periphery of said rotor and said flux ring.

19. The cooling module according to claim 14, wherein a substantially sealed connection is provided between said winding and said electronic control unit.

20. A method of providing a cooling module comprising:

providing a fan having a fan hub and a plurality of blades extending from said fan hub;

providing a shroud structure spaced from and generally adjacent to said blades; and providing a brushless electric motor for rotating said fan, said electric motor comprising:

a heat sink structure;

a shaft fixed to said heat sink structure;

a rotor mounted for rotation with respect to said shaft, magnets fixed in relation to said rotor so as to rotate with said rotor;

a lamination core fixed to said heat sink structure; and a winding wound about said lamination core and operatively associated with said magnets;

coupling said heat sink structure to said shroud structure; and coupling said fan hub to said rotor.

21. The method according to claim 10, wherein said motor further includes an electronic control unit to power said winding, the step of coupling said heat sink structure to said shroud structure includes placing said electronic control unit between said heat sink structure and said shroud structure.

* * * * *